US009642189B2

(12) United States Patent
Gries et al.

(10) Patent No.: US 9,642,189 B2
(45) Date of Patent: May 2, 2017

(54) ELECTRIC HEATER

(71) Applicant: MAHLE International GmbH, Stuttgart (DE)

(72) Inventors: Jean-Philippe Gries, Colmar (FR); Christophe Schmittheisler, Epfig (FR)

(73) Assignee: MAHLE International GmbH, Stuttgart (DE)

( * ) Notice: Subject to any disclaimer, the term of this patent is extended or adjusted under 35 U.S.C. 154(b) by 194 days.

(21) Appl. No.: 14/556,912

(22) Filed: Dec. 1, 2014

(65) Prior Publication Data

US 2015/0156820 A1 Jun. 4, 2015

(30) Foreign Application Priority Data

Dec. 3, 2013 (EP) ..... 13290297

(51) Int. Cl.

| | |
|---|---|
| ***H05B 3/24*** | (2006.01) |
| ***H05B 3/06*** | (2006.01) |
| ***H05B 3/04*** | (2006.01) |
| ***F24H 3/04*** | (2006.01) |
| ***H01C 7/02*** | (2006.01) |

(52) U.S. Cl.

CPC ..... *H05B 3/04* (2013.01); *F24H 3/0429* (2013.01); *F24H 3/0441* (2013.01); *H01C 7/02* (2013.01); *H05B 3/06* (2013.01); *H05B 3/24* (2013.01); *F24H 2250/04* (2013.01); *H05B 2203/02* (2013.01); *H05B 2203/023* (2013.01)

(58) Field of Classification Search

None

See application file for complete search history.

(56) References Cited

U.S. PATENT DOCUMENTS 6,919,535 B2 * 7/2005 Uhl ..... B60H 1/2225 165/80.3
8,803,036 B2 * 8/2014 Niederer ..... H01R 9/091 219/202
2002/0011484 A1 * 1/2002 Beetz ..... B60H 1/2218 219/530
2003/0180033 A1 * 9/2003 Alban ..... F24H 3/0429 392/347
2004/0112884 A1 * 6/2004 Uhl ..... B60H 1/034 219/202
2005/0173394 A1 * 8/2005 Bohlender ..... H01H 37/76 219/202
2013/0161306 A1 * 6/2013 Bohlender ..... H05B 3/02 219/202
2013/0161308 A1 * 6/2013 Bohlender ..... H05B 3/02 219/202
2015/0108111 A1 * 4/2015 Gries ..... F24H 3/0429 219/486
2015/0108112 A1 * 4/2015 Gries ..... F24H 3/0429 219/486
2015/0108117 A1 * 4/2015 Gries ..... B60H 1/2215 219/539
2015/0296566 A1 * 10/2015 Gries ..... H05B 3/06 219/541
2016/0214463 A1 * 7/2016 Gries ..... H05B 1/0236

FOREIGN PATENT DOCUMENTS

| | | |
|---|---|---|
| DE | 10 2011 000719 A1 | 8/2011 |
| DE | 10 2011 089539 B3 | 4/2013 |
| EP | 2 330 865 A1 | 6/2011 |

* cited by examiner

*Primary Examiner* — Joseph M Pelham

(74) *Attorney, Agent, or Firm* — Muncy, Geissler, Olds & Lowe, P.C.

(57) ABSTRACT

An electric heater for an automobile vehicle, having at least one heating element and at least one circuit board, with the circuit board being connected to a control unit and/or to a power supply and having at least one contact area through which an electrical connection between a heating element and a control unit and/or a power supply can be realized, the heating element possessing at least one PTC-heating element, with the heating element being connected to the circuit board with at least one connecting element, whereby the first connecting element features at least one protruding element and the contact area offering at least one through hole, with the at least one protruding element being insertable into the at least one through hole of the contact area.

9 Claims, 1 Drawing Sheet

ELECTRIC HEATER

This nonprovisional application claims priority under 35 U.S.C. §119(a) to European Patent Application No. EP 13290297.4, which was filed on Dec. 3, 2013, and which is herein incorporated by reference.

BACKGROUND OF THE INVENTION

Field of the Invention

The invention relates to an electric heater for an automobile vehicle, comprising at least one heating element and at least one circuit board, with the circuit board being connected to a control unit and/or to a power supply and having at least one contact area through which an electrical connection between a heating element and a control unit and/or a power supply can be realized, the heating element possessing at least one PTC-heating element, with the heating element being connected to the circuit board with at least one connecting element.

Description of the Background Art

Electric heaters usually have at least one heating element, which can be heated by applying an electric current to the element. The heat is then transported via fins or other thermally conductive parts to a heat sink. The heat sink can thus be heated by the heating element. To control the electric current on the heating element, electric heaters also possess a control unit. This control unit is either directly connected to each heating element or via a bus bar, which is connected to the control unit and a multitude of heating elements.

Electric heaters known in the conventional art have a connection assembly between the heating elements and the control unit and/or the power supply and/or the bus bar. The connection assembly is usually built of a male connector and a female connector. Due to the nature of such a connection assembly the electric heater is exposed to mechanical stress while the connectors are being connected.

Furthermore the connection assembly can be exposed to corrosion, humidity or mechanical stress due to its location within the electric heater. Especially, if the individual heating elements are connected by a connection assembly to a common bus-system, which is connected to a power supply, the assembling of every heating element will cause mechanical stress to all the other already assembled heating elements. This can lead to damage within the connection assemblies or the heating elements.

Furthermore it is difficult to achieve a connection assembly that is sufficiently sealed off against water or humidity. The number of connections between the elements of the electric heater is usually very high, as a huge quantity of elements needs to be connected to each other, e.g. the heating elements, the bus bar, the circuit boards, the control unit and the power supply.

An entry of water or humidity can lead to fretting corrosion and hence to failure of the electric heater. Due to the environment in which such electric heaters are usually used, the connector has to fulfill a high level of requirements over the full lifetime to prevent failure. Electric heaters of this kind are usually used within automobile vehicles to support the heating of the engine or the interior of the vehicle.

SUMMARY OF THE INVENTION

It is therefore an object of the present invention to provide an electric heater which has an improved connection between a heating element and a circuit board of the electric heater, whereby the connection can be obtained with a minimum of mechanical stress to the electric heater. Furthermore the electric heater should be easily producible.

According to an embodiment of the invention an electric heater for an automobile vehicle is provided, having at least one heating element and at least one circuit board, with the circuit board being connected to a control unit and/or to a power supply and having at least one contact area through which an electrical connection between a heating element and a control unit and/or a power supply can be realized, the heating element possessing at least one PTC-heating element, with the heating element being connected to the circuit board with at least one connecting element, wherein the first connecting element features at least one protruding element and the contact area offering at least one through hole, with the at least one protruding element being insertable into the at least one through hole of the contact area.

The protruding element can be inserted into the through hole of the contact area to create a connection between the connecting element and the contact area. The contact area is either coated with an electrical conductive material or is built completely of such a material. Preferably the inner surfaces of the through holes are electrical conductive as well. With the protruding elements being electrical conductive as well, it is easy to create an electrical conductive connection between the connecting element and the contact area.

The contact area can be connected to a control unit and/or a power supply by conductive paths that are printed on the circuit board or that are applied to the circuit board using other techniques. The contact area acts as the interface between the control unit and/or the power supply and the heating element directly or the connecting element, which is preferably connected in an electrical conductive way to the heating element. The connecting element thus acts as a connection bridge between the circuit board and the heating element. This is preferable as the bus bar or bus-system that is used in electric heaters that are known in the state of the art is not needed as the heating elements are connected directly to the circuit board by the connecting element.

Furthermore, the connection between the heating elements and the circuit boards can be created before the circuit boards are connected to the control unit, the power supply or other structures of the electric heater. This is beneficial as the mechanical stress for the rest of the electric heater due to the connection between the heating element and the circuit board can be limited or even cancelled out.

The protruding element, which can be inserted into the through holes, restricts the relative movement between the connecting element and the contact area of the circuit board in the two directions that are perpendicular to the longitudinal extension of the protruding element. The relative movement in the third direction, which is parallel to the extrusion of the protruding element, can be restricted by a press fit of the protruding element in the through hole.

Furthermore, a cross-section of the through hole can be smaller than the cross-section of the protruding element.

By a cross-section of each protruding element, that is smaller than the cross-section of the corresponding through hole, a press fit can be achieved. An assembly force is needed to insert the protruding elements in their corresponding through holes.

Further, the connection between the through holes of the contact area and/or a second connecting element and the protruding elements can be realized by a press fit. A press fit can be generated through an at least slightly wider cross-section of each protruding element compared to the cross-section of the corresponding through hole. The press fit is advantageous to secure the protruding elements within the through hole. The press fit prevents relative movement between the first connecting element and the circuit board.

Furthermore, the contact area can feature a multitude of through holes, which are arranged in either a regular pattern or an irregular pattern, and the connecting element featuring a multitude of protruding elements, with the quantity of protruding elements being less or equal or superior to the quantity of through holes.

In an embodiment each through hole in the contact area can correspond to a protruding element of the first connecting element. The pattern in which the protruding elements are arranged can be identical to the pattern in which the through holes are arranged. By these identical patterns it is possible to insert every protruding element into a corresponding through hole. In an alternative embodiment it is possible that the quantity of through holes is bigger than the quantity of protruding elements. In such a case some of the through holes remain unused and empty if the first connecting element is attached to the contact area.

In an embodiment, the protruding element can be formed through a beam-shaped element.

The protruding elements can be built as beam-shaped elements. The shape of the cross-section of the protruding elements can thereby be amongst others circular, octagonal, oval, elliptic or polygonal. In an embodiment the shape of the cross-section of the through holes can be identical to the shape of the cross-sections of the protruding elements. This is however not required as the press fit between the protruding elements and the through holes can also be achieved by diverging shapes of the respective cross-sections.

According to an embodiment of the invention, the first connecting element can be plate-shaped with two laminar surfaces that are arranged opposed to each other, with the protruding elements being arranged on one of the laminar surfaces of the first connecting element. The plate-shaped form of the first connecting element is advantageous to create a planar contact between the contact area and the first connecting element. The contact area is thereby preferably planar as well.

In an embodiment, a second connecting element can be provided that is plate-shaped and features a multitude of through holes, with the through holes in the second connecting element being arranged in an identical pattern to the through holes in the contact area, and the second connecting element being connected to the heating element.

The second connecting element can feature through holes that are arranged identical to the through holes in the contact area. This is advantageous as protruding elements can be pushed through the through holes of the contact area and the through holes of the second connecting element to connect the first connecting element and the second connecting element to the contact area of the circuit board. Thereby, the cross-section of the through holes in the second connecting element can be smaller than the cross-section of the protruding elements to create a press fit between the protruding elements and the second connecting element.

Furthermore, the protruding elements of the first connecting element can be inserted in the through holes of the contact area and into the through holes of the second connecting element. By inserting the protruding elements in the through holes of the contact area and the through holes of the second connecting element a connection between all three elements can be achieved without the need for additional fixation elements.

Besides this it is preferable, if the first connecting element is in laminar contact with one of the two planar sides of the circuit board whereas the second connecting element is in laminar contact with the second planar side of the circuit board. The circuit board, especially the contact area, is arranged between the first connecting element and the second connecting element. The contact area is thereby built in a way that it offers an electrical conductive surface for both of the connecting elements.

In an embodiment the electrical connection between the contact area and the second connecting element can be realized by an electrical conductive connection between the contact area and the first connecting element and furthermore by an electrical conductive connection between the protruding elements of the first connecting element and the second connecting element. A dedicated electrical conductive connection between the contact area and the second connecting element is thereby not needed. An embodiment provides an electrical conductive contact between the contact area and the second connecting element. The first connecting element is then only used to fix the second connecting element to the contact area of the circuit board. In a still further embodiment both connecting elements can be connected to the contact area in an electrically conductive way.

Furthermore, the first connecting element and/or the second connecting element can be connected to the heating element by means of glue and/or screws and/or clips and/or braze points and/or by way of clinching. Depending on the specific embodiment of the heating element either the first or the second connecting element can be connected to the heating element in an electrical conductive way. This can be realized by different connecting materials like the above mentioned, which are all well known in the art. Either by connecting the first connecting element or the second connecting element to the heating element, an electrical conductive connection can be reached. The PTC-heating elements, which are distributed across the heating element, can thus be connected to a control unit and/or a power supply. The activation or deactivation of the heating elements can be realized either by switches at the power supply or by the control unit, which can be arranged in the electric circuit between the power supply and the heating elements.

In another embodiment, the circuit board and/or the first connecting element and/or the second connecting element can be encased in a waterproof housing. A waterproof housing protects the circuit board and the electrical connection between the circuit board and the heating element from humidity and other corrosive influences. The housing can offer openings through which the heating elements can pass through. The opening can easily be sealed by sealing elements which are well known in the state of the art.

In another embodiment a multitude of circuit boards can be encased within a waterproof housing. The connection between the circuit boards and the power supply and/or the control unit can also be encased within the housing. This is especially beneficial as it helps to prevent short-circuits or corrosion within the electrical connections of the electric heater. Openings in the housing, which build a passage for elements to pass through the walls of the housing, can be sealed by sealing elements that are well known in the state of the art.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
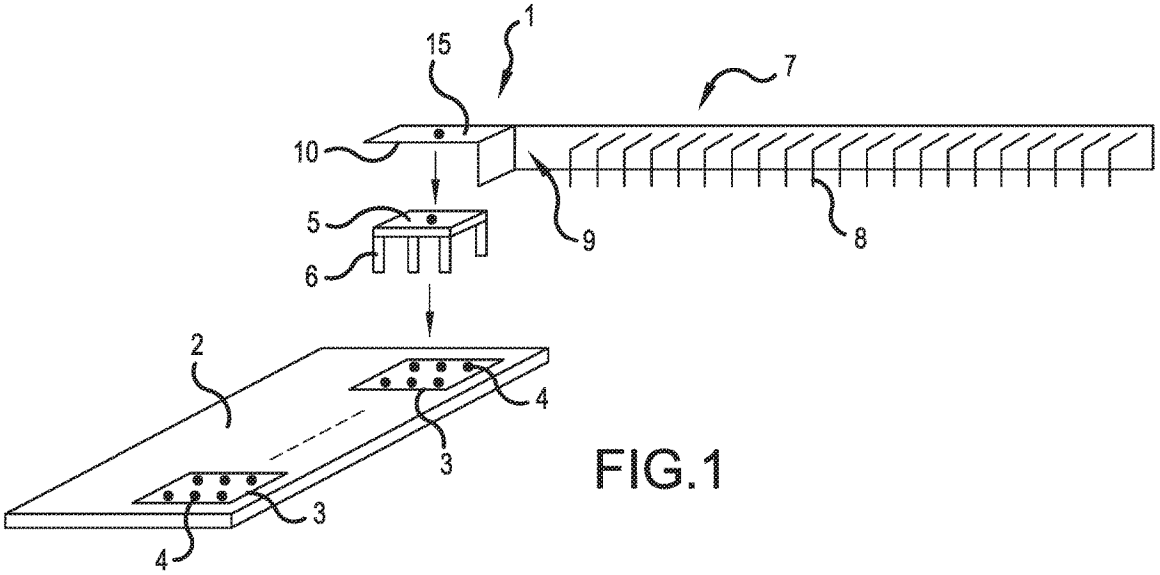
FIG. 1 shows a circuit board with two contact areas that are electrically connected to a not shown power supply or a control unit, furthermore a heating element that can be connected to the circuit board by a connecting element, which features a multitude of protruding elements, is shown next to the circuit board.

FIG. 1 shows an exploded view of an electric heater 1. The electric heater comprises a first heating element 7, which features a multitude of heat dissipating fins 8 and at least one PTC-heating element (not shown in FIG. 1). The PTC-heating elements can be used to generate heat by applying an electric current to them. The electric current can be obtained from a power supply (not shown in FIG. 1). Furthermore the electric heater possesses a control unit and a connection to a power supply. Both are not shown in FIG. 1. In a preferred embodiment the electric heater 1 features a multitude of heating elements 7 that are connected to a circuit board 2.

The heating element 7 has an L-shaped body 9. The longer flank of the L-shaped body 9 features the multitude of the heat dissipating fins 8 and the PTC-heating elements that are not shown in FIG. 1. The heat dissipating fins 8 and the PTC-heating elements can be distributed on one side or on both sides of the longer flank of the L-shaped body.

The shorter flank of the L-shaped body 9 is also part of a second L-shaped body 15. The longer flank of the second L-shaped body 15 features a connecting area 10 to which a connecting element 5 can be attached. This connecting element 5 is shown between the heating element 7 and the circuit board 2. The build-up of the heating element 7 is exemplary. In alternative embodiments it can be built differently without deviating from the scope of the invention. Important is, that the heating element possesses at least one PTC-heating element, on which a current can be applied through either the body of the heating element or other electrical conductive device.

The circuit board 2 is shown underneath the heating element 7 and the connecting element 5. The circuit board 2 features two contact areas 4 that are connected to either a power supply or a control unit by printed paths on the surface of the circuit board 2. By connecting the heating element 7 to the contact area 2 an electrical connection can be realized.

The connecting element 5 has a planar plate-shaped element with a multitude of protruding elements 6 on the lower side of the plate-shaped element. The upper side of the plate-shaped element can be attached to the connecting area 10 of the heating element 7 by means that are well known in the state of the art, e.g. screws, braze joints, glue or clips.

The protruding elements 6 are beam-shaped and have a cross-section that has among other possible shapes a circular, an elliptic or a polygonal shape. The cross-section of the protruding elements 6 can be unvaried along the vertical extension of the protruding elements 6 or it can change. A preferred embodiment is characterized by a cross-section that grows bigger from the free end of the protruding elements 6 to the plate-shaped element. This is advantageous as it is easier to insert the protruding elements into through holes, such as the through holes 4 of the contact area 3.

The through holes 4 of the contact area 3 are piercing through the circuit board 2. The protruding elements 6 can therefore be inserted into the through holes 4. The cross-section of the protruding elements 6 is thereby bigger than the cross section of the corresponding through holes 4. A so called press fit can be created by pressing the protruding elements 6 into the through holes 4. The press fit is caused by the bigger cross-section of the protruding elements 6 compared to the cross-section of the through holes 4.

The contact area 3 can be made of an electrical conductive material which is connected to a power supply and/or a control unit via printed paths on the circuit board 2 or otherwise applied paths on the circuit board 2.

The connecting element 5 is preferably made of an electrical conductive element as well. An electric current can therefore be transported through the contact area 3 to the connecting element 5 and finally to the heating element 7, to which the PTC-heating elements are electrically connected. By this build-up the PTC-heating elements can be connected to at least one pole of a power supply. The connection to a second pole of a power supply can be created through other electrical conductive elements, such as cables or bridges or adjacent heating elements. In an embodiment where the circuit is closed through a connection between adjacent heating elements, it is preferable, if the adjacent heating elements are connected in an alternating way to either the positive pole or the negative pole of a power supply.

Every circuit board 2 features a multitude of contact areas 3. One heating element 7 is connected to each contact area 3 by the means of a connecting element 5.

The press fit between the protruding elements 6 and the contact area 3 restricts relative movement between the heating element 7 and the circuit board 2 in all three spatial directions. To create a press fit an assembly force is needed to press the protruding elements 6 into the through holes 4.

Figure 2:
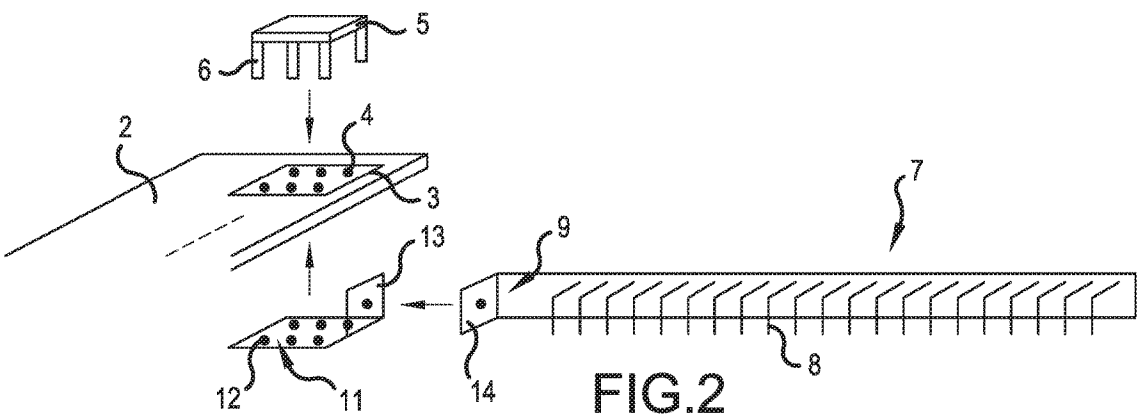
FIG. 2 shows an embodiment, where the heating element can be connected to the contact area of the circuit board through a first connecting element, which features a multitude of protruding elements, and a second connecting element, which features a multitude of through holes.

FIG. 2 shows an embodiment of an electric heater 1. The heating element 7 is built as an L-shaped body 9, which features a longer flank and a shorter flank. As already shown in FIG. 1 the longer flank of the L-shaped body 9 features the heat dissipating fins 8 and the PTC-heating elements, which are not shown. The shorter flank features a connecting area 14. A second connecting element 11 can be connected to the connecting area 14 by means that are known in the state of the art, e.g. screws, glue, braze joints or clips.

The second connecting element 11 is made of a plate-shaped planar body, which possesses a multitude of through holes 12. Furthermore the second connecting element 11 features a connecting area 13 which is perpendicular to the planar area of the connecting element 11 that features the through holes 12. The connecting area 13 can be connected to the connecting area 14.

The through holes 12 in the second connecting element 11 are arranged in an identical pattern to the through holes 4 in the circuit board 2. The second connecting element 11 can be placed on the lower surface of the circuit board in a way that the through holes 4 correspond with the through holes 12. A first connecting element 5, which is identical with the first connecting element 5 from FIG. 1, can then be pressed to the upper surface of the circuit board 2. The protruding elements 6 will be inserted into the through holes 4 and 12 and thus create a solid connection between the first connecting element 5, the circuit board 2 and the second connecting element 11.

In an embodiment, the second connecting element 11 and the first connecting element 5 can be placed on the same side of the circuit board 2. If both connecting elements 5, 11 are arranged on the same side of the circuit board, the second connecting element 11 needs to be placed between the circuit board 2 and the first connecting element 5 to achieve a fixation of the second connecting element 11.

The contact areas 3, the first connecting element 5 and the second connecting element 11 can either be made from an electrically conductive material or they can be coated with such a material. Important is that an electrically conductive connection between the heating element 7 and the printed paths of the circuit board 2, which are connected to a power supply and/or a control unit, can be created by using the connecting elements 5 and 11.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An electric heater for a vehicle, the electric heater comprising:

at least one heating element;

at least one circuit board connected to a control unit and/or to a power supply; and at least one contact area through which an electrical connection between the heating element and the control unit and/or the power supply is realized, wherein the heating element has at least one PTC-heating element, wherein the heating element is connected to the circuit board with at least one first connecting element, wherein the at least one first connecting element has at least one protruding element, wherein the contact area has at least one through hole, wherein the at least one protruding element is insertable into the at least one through hole of the contact area, and wherein the first connecting element is plate-shaped with two laminar surfaces that are arranged opposed to each other, with the protruding element being arranged on a laminar surface of the first connecting element.

2. The electric heater as claimed in claim 1, wherein a cross-section of the through hole is smaller than a cross-section of the protruding element.

3. The electric heater as claimed in claim 1, wherein the contact area has a multitude of through holes, which are arranged in either a regular pattern or an irregular pattern, and wherein the first connecting element has a plurality of protruding elements, and wherein a quantity of protruding elements is equal or greater that a quantity of through holes.

4. The electric heater as claimed in claim 1, wherein the protruding element is formed through a beam-shaped element.

5. An electric heater for a vehicle, the electric heater comprising:

at least one heating element;

at least one circuit board connected to a control unit and/or to a power supply; and at least one contact area through which an electrical connection between the heating element and the control unit and/or the power supply is realized, wherein the heating element has at least one PTC-heating element, wherein the heating element is connected to the circuit board with at least one first connecting element, wherein the at least one first connecting element has at least one protruding element, wherein the contact area has at least one through hole, wherein the at least one protruding element is insertable into the at least one through hole of the contact area, and wherein a second connecting element is provided that is plate-shaped and has a plurality of through holes, wherein the through holes in the second connecting element are arranged in an identical pattern to the through holes in the contact area, and wherein the second connecting element is connected to the heating element.

6. The electric heater as claimed in claim 5, wherein the protruding elements of the first connecting element are inserted in the through holes of the contact area and into the through holes of the second connecting element.

7. The electric heater as claimed in claim 6, wherein the first connecting element is in laminar contact with one of two planar sides of the circuit board, and wherein the second connecting element is in laminar contact with the second planar side of the circuit board.

8. The electric heater as claimed in claim 5, wherein the first connecting element and/or the second connecting element is connected to the heating element by glue and/or screws and/or clips and/or braze points and/or clinching.

9. The electric heater as claimed in claim 5, wherein the circuit board and/or the first connecting element and/or the second connecting element is encased in a waterproof housing.

* * * * *